US006685502B2

(12) United States Patent
Wheeler

(10) Patent No.: US 6,685,502 B2
(45) Date of Patent: Feb. 3, 2004

(54) RETAINING DEVICE FOR TRAILER WIRING

(76) Inventor: Mark Eldridge Wheeler, 315 Carlson, Maryland Heights, MO (US) 63043

( * ) Notice: Subject to any disclaimer, the term of this patent is extended or adjusted under 35 U.S.C. 154(b) by 0 days.

(21) Appl. No.: 10/132,984

(22) Filed: Apr. 26, 2002

(65) Prior Publication Data

US 2003/0203670 A1 Oct. 30, 2003

(51) Int. Cl.[7] ..... H01R 13/72

(52) U.S. Cl. ..... 439/501; 439/503; 439/35; 439/38; 439/369; 439/371; 439/528

(58) Field of Search ..... 439/501, 503, 439/35, 38, 369, 371, 528

(56) References Cited

U.S. PATENT DOCUMENTS 4,484,185 A * 11/1984 Graves ..... 340/656
4,772,220 A 9/1988 Hallier, Jr.
4,940,427 A 7/1990 Pearson
5,129,828 A 7/1992 Bass
5,308,253 A * 5/1994 Maki ..... 439/148
5,630,728 A * 5/1997 Watters, Jr. ..... 439/528
5,669,471 A 9/1997 Unze
5,988,569 A * 11/1999 Zhang et al. ..... 248/65
6,033,251 A * 3/2000 Cook ..... 439/369
6,089,907 A * 7/2000 Shoblom ..... 439/528

* cited by examiner

*Primary Examiner*—Tho D. Ta
(74) *Attorney, Agent, or Firm*—Thompson Coburn LLP

(57) ABSTRACT

A retaining device for trailer wiring comprises a main body portion, at least one retaining element and a cohesive member. The retaining element is connected to the main body portion and is adapted for engagement with a portion of a trailer wiring assembly in a manner for holding the portion of the assembly relative to the main body portion of the retaining device. The cohesive member is connected to the main body portion of the retaining device and is adapted for removably cohering the retaining device to a support surface.

13 Claims, 2 Drawing Sheets

RETAINING DEVICE FOR TRAILER WIRING

BACKGROUND OF THE INVENTION

1. Field of the Invention

The present invention relates to a retaining device for trailer wiring. More particularly, the present invention relates to a retaining device for receiving and holding the wiring from the electrical system connection between a trailer and a towing vehicle.

2. Related Art

Vehicle trailers are generally required to have tail lights and brake lights, which are connected to and synchronized with the corresponding lights of the towing vehicle. Because the trailers are typically detachable, permanent wiring between the trailer and the towing vehicle is not practical. Thus, the electrical wires upstream of the trailer lights typically terminate in a socket element or other electrical connector, which is configured for separable connection to a complementary electrical connector of the towing vehicle. When a trailer is not connected to a towing vehicle, its wiring and associated electrical connector need restraint so that they do not dangle or otherwise hang loose. Similarly, the electrical wires and electrical connector of the towing vehicle need to be restrained so that they do not dangle or trail behind the vehicle as the vehicle is operated when a trailer is not attached. Restraint of these elements is important to prevent damage and to keep them clean, safe and ready for use when a trailer is to be connected to the towing vehicle.

In the prior art, a number of methods have been used for temporarily securing the respective electrical wires and electrical connectors to the trailer and towing vehicle when the trailer is not connected to the towing vehicle. One economical method includes wrapping the wiring around the trailer hitch of the towing vehicle. However, this is unsightly and generally not very effective as the wires may become unwrapped and then damaged by contact with the road or the towing vehicle. Another problem with this method is that the wires may be crimped or stretched, rendering them inoperable. Other prior art methods for securing trailer wiring when not in use includes bolting or drilling into the frame or body of the towing vehicle or trailer to permanently install a clip or bracket that is used to retain the excess wiring. However, this requires permanent defacing of the vehicle or trailer and is generally more cumbersome and expensive. Other, more sophisticated approaches have been attempted, including the use of a spring-biased recoil device mounted behind the license plate of the towing vehicle that coils the wiring when not in use. However, again, this requires a permanent fixture to be mounted near the trailer hitch of the towing vehicle. Moreover, spring-biased recoil devices are susceptible to breakage and malfunction due to the spring mechanism and other moving parts. Thus, the prior art has not heretofore yielded an ideal solution to this problem.

SUMMARY OF THE INVENTION

It is an object of the present invention to provide a retaining device for trailer wiring that is removably mountable to a trailer or towing vehicle without the need for permanent fixtures and without the need to permanently deface the surface of the trailer or towing vehicle to which a retaining device is attached. A related object of the invention is to provide a retaining device for trailer wiring that is magnetically mountable to a ferromagnetic surface of a trailer or towing vehicle. Yet another object of the invention is to provide a retaining device for trailer wiring that can be inexpensively manufactured and easily used without tools.

In general, a retaining device of the present invention comprises a main body portion, at least one retaining element, and a cohesive member. The retaining element is connected to the main body portion. The retaining element is adapted for engagement with a portion of a trailer wiring assembly in a manner for holding the portion of the assembly relative to the main body portion of the retaining device. The cohesive member is connected to the main body portion of the retaining device. The cohesive member is adapted for removably cohering the retaining device to a support.

In another aspect of the present invention, a retaining device for trailer wiring comprises a main body portion, at least one retaining element, and a magnetic member. The retaining element is connected to the main body portion of the retaining device. The retaining element is adapted for engagement with a portion of a trailer wiring assembly in a manner for holding the portion of the assembly relative to the main body portion of the retaining device. The magnetic member is connected to the main body portion. The magnetic member is adapted for magnetically attaching the retaining device to a ferromagnetic support surface.

In still another aspect of the invention, a method of retaining trailer wiring comprises the steps of: providing a trailer wire retaining device having a wire retaining element and a magnetic member; securing a portion of a trailer wiring assembly to the wire retaining element of the retaining device; and magnetically attaching the magnetic member of the retaining device to a ferromagnetic surface, whereby the portion of the trailer wire assembly is secured to the ferromagnetic surface.

Further objects, features, and advantages of the present invention, as well as the structure and operation of various embodiments of the present invention, are described in detail below with reference to the accompanying drawings.

Figure 1:
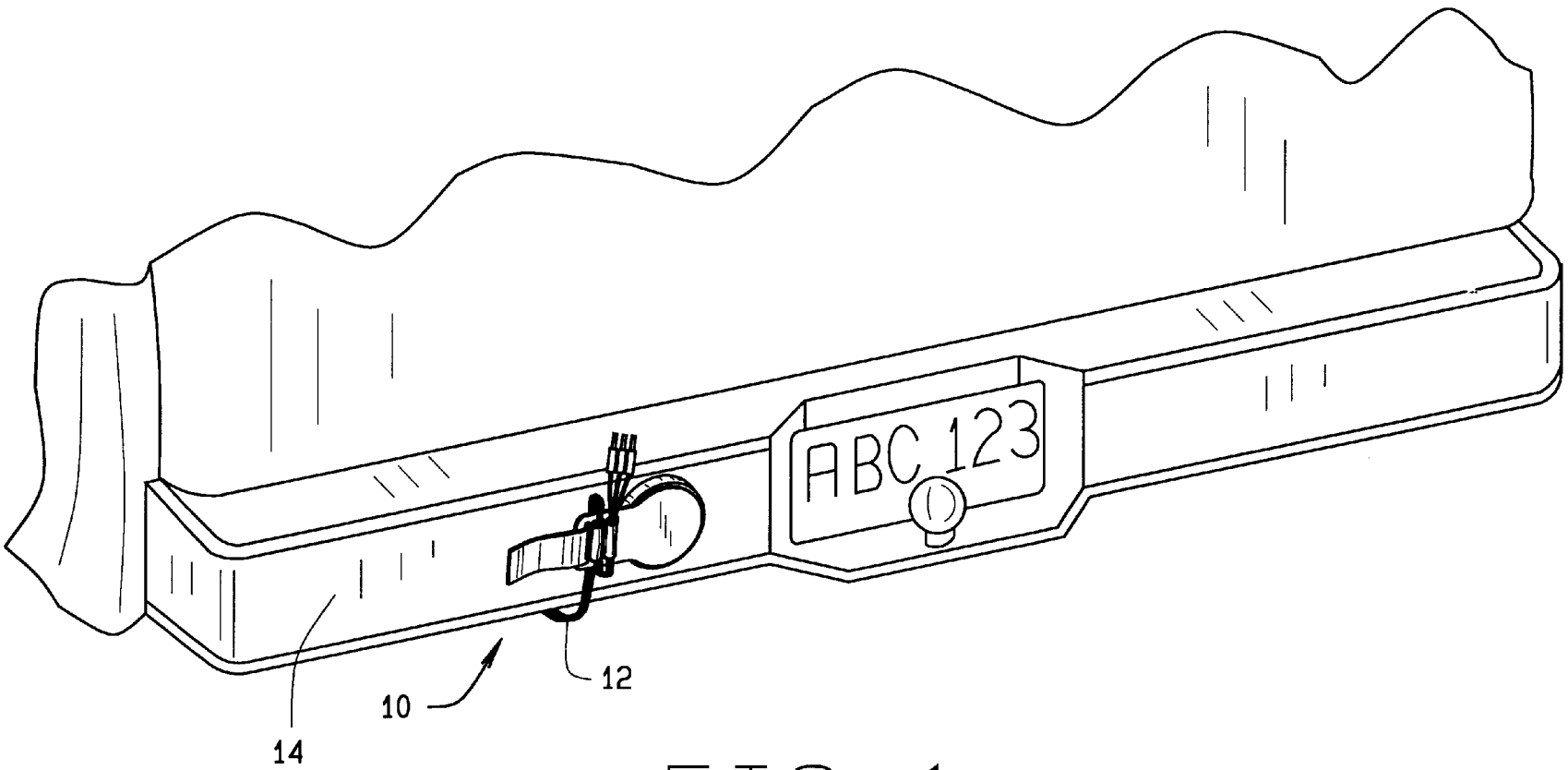
FIG. 1 is a perspective view of a preferred embodiment of a retaining device of the present invention, shown attached to the bumper of a towing vehicle.
Figure 2:
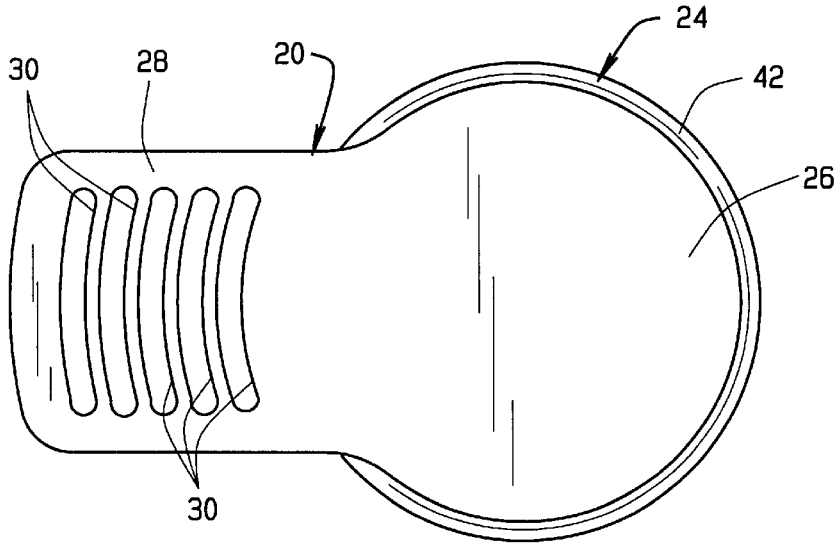
FIG. 2 is a top plan view of the retaining device of FIG. 1, with the flexible strap removed to show detail of the remainder of the device.

Reference characters used in these drawings correspond with reference characters used throughout the Detailed Description of the Preferred Embodiments, which follows. These drawings, which are incorporated in and form a part of the specification, illustrate the preferred embodiments of the present invention and, together with the description, serve to explain the principles of the invention.

DETAILED DESCRIPTION OF THE PREFERRED EMBODIMENTS

A retaining device of the present invention is represented generally in FIG. 1 by the reference numeral 10. In FIG. 1, the retaining device 10 is shown in one preferred environment wherein it is retaining a portion of a trailer electrical wire assembly 12 and is mounted to the bumper of a towing vehicle 14.

As best shown in FIGS. 2 through 5, the retaining device 10 comprises a main body portion 20, a retaining element 22, and a cohesive member 24. The main body portion 20 is preferably generally planar, and comprises a generally round central portion 26 with a generally rectangular portion 28 extending therefrom. The rectangular portion 28 includes a plurality of slots 30 arranged generally in line with one another. These slots 30 are discussed in greater detail below. Preferably, the generally planar main body portion 20 is formed from 16-gauge cold rolled steel, though other materials could be used and other methods of manufacture of this component could be employed without departing from the scope of the present invention.

The retaining element 22 is connected to the main body portion 20, in a manner described below, and is adapted for engagement with a portion of a trailer wiring assembly 12 (FIG. 1) in a manner for holding the portion of the assembly 12 relative to the main body portion 20 of the retaining device 10. As discussed below in more detail, the cohesive member 24 is connected to the main body portion 20 of the retaining device 10 and is adapted for removably cohering the retaining device 10 to a trailer, towing vehicle, or other support 14 (FIG. 1).

Figure 3:
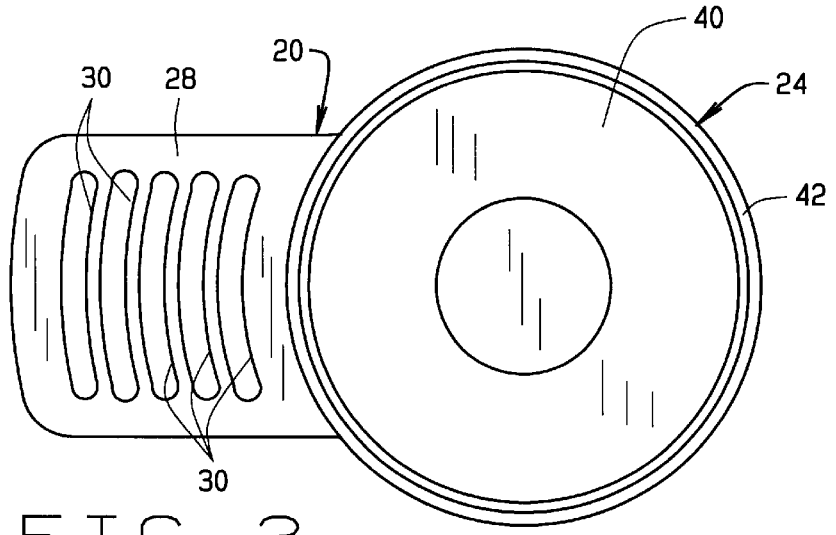
FIG. 3 is a bottom plan view of the retaining device, again shown with the flexible strap removed to show detail of the remainder of the device.
Figure 4:
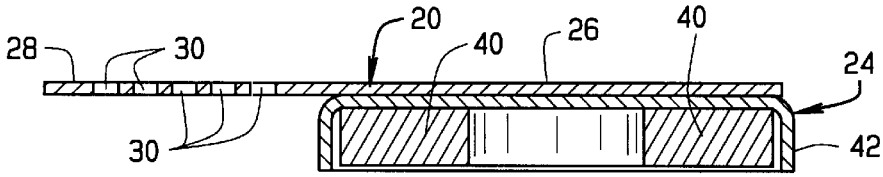
FIG. 4 is a cross-sectional side view taken along the plane of line 4—4 in FIG. 2.

Preferably, the cohesive member 24 comprises a magnetic member that is adapted for mounting to a ferromagnetic surface 14, e.g., a trailer, towing vehicle, or other support (FIG. 1). As best shown in FIGS. 3 and 4, the magnetic member 24 preferably comprises a magnetic assembly having a permanent ceramic magnet 40 bonded to a cup-shaped steel armature 42. Magnetic assemblies are preferred because magnetic strength can be multiplied many times by using steel armatures to concentrate magnetic flux. Usually, such armatures take the form of steel backing plates, channels or cups. Magnetic assemblies of this kind are relatively inexpensive and are readily available in the marketplace. One distributor of such magnetic assemblies is Northwest Magnet. In the preferred embodiment of the invention, the magnetic cup assembly 24 comprises a steel cup with about a 2⅜" diameter and height of about 0.350" and the ceramic magnet affixed to the inside of the cup is approximately 2" in diameter. Preferably, the magnet 40 is bonded to the inside of the cup 42 with glue or another suitable adhesive. However, it should be understood that components of other dimensions and materials could be used in the magnetic assembly 24 without departing from the scope of the present invention. For example, magnetic cup assemblies of different dimensions, or magnetic channel assemblies could be used without departing from the scope of the present invention, as defined by the following claims. Also, it should be understood that, instead of a magnet, the cohesive member 24 may comprise an adhesive for removably or permanently adhering the retaining device to a support, without departing from the scope of the present invention.

Figure 5:
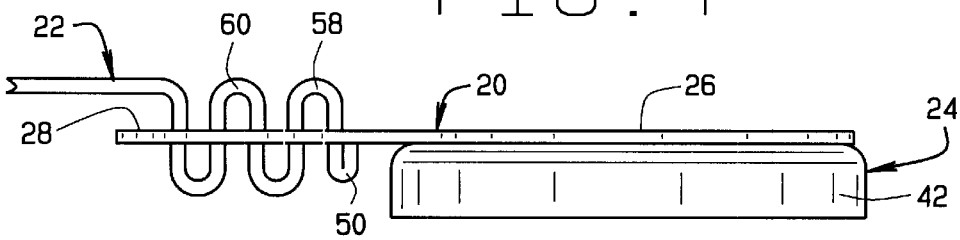
FIG. 5 is a side elevational view similar to FIG. 4, but showing a preferred configuration of the flexible strap used in accordance with the retaining device.

As shown in FIGS. 1 and 5, the retaining element 22 is connected to the main body portion 20 and is adapted for engagement with a portion of a trailer wiring assembly 12 (FIG. 1) in a manner for holding the portion of the assembly 12 relative to the main body portion 20 of the retaining device 10. Preferably, the retaining element 22 comprises a flexible strap made of polypropylene or nylon webbing, though other materials could be used without departing from the scope of the present invention. As shown in FIG. 5, the strap 22 has one end 50 secured to the main body portion 20. More specifically, the end 50 is preferably secured adjacent an inner most slot 30 of the rectangular portion 28 of the main body portion 20 by being folded upon itself and sewn, stitched, glued or otherwise secured in this configuration so that it cannot pass through the slot 30. Each of the slots 30 is preferably sized and shaped to receive the flexible strap 22 therethrough and, preferably, the remainder of the strap 22 is threaded back and forth through the slots 30 (as illustrated in FIG. 5), in a manner to form a first loop 58 and a second loop 60, each being adapted to wrap or "loop" around a portion of the trailer wiring assembly 12 in a manner for holding the wiring assembly 12 relative to the main body portion 20 of the retaining device 10. Excess webbing is preferably threaded through the slot closest to the distal end of the rectangular portion 28 of the main body portion 20.

Preferably, the closed side of the cup-shaped steel armature 42 is permanently bonded to one side of the round central portion 26 of the main body member 20 by welding, gluing or another suitable manner of permanent affixation. Then, preferably, the entire device (including the main body portion 20 and magnetic assembly 24, but excluding the flexible strap 22) is coated with a powder coating. Powder coating is a dry finishing process, wherein finely ground particles of pigment and resin are electrostatically charged and then sprayed onto the part(s) to be coated. The coating process can be performed manually or by machine, as is well known in the art. The parts to be coated are electrically grounded so that the charged particles projected at them adhere to the parts and are held there until melted and fused into a smooth coating in a curing oven. The result is a uniform, durable; high quality finish that is also environmentally friendly. Powder coating provides a finish that is impact abrasion and corrosion resistant, and also provides a soft contact surface, which is less likely to scratch the vehicle bumper or other surface to which the retaining device 10 is mounted. Wright Coating Company is one provider of powder coating services.

Alternatively, the entire device (excluding the flexible strap 22) may be coated with an insulating material, such as a plastisol plastic spray. Plastisol spraying also produces a finish that is impact abrasion and corrosion resistant, and which provides a soft contact surface that is less likely to scratch the vehicle bumper or other surface to which the retaining device 10 is mounted. Wright Coating Company also distributes plastisol dips and sprays for coating purposes.

Another alternative to powder coating or spray coating is manufacture the main body portion 20 and cohesive member 24 as a monolithic piece of injection molded plastic, which would also provide a soft contact surface that is unlikely to scratch the vehicle bumper or other surface to which the retaining device 10 is mounted. Still other materials could be used without departing from the scope of the present invention.

The present invention also contemplates a method of retaining trailer wiring, the method comprising the steps of: providing a trailer wire retaining device 10 having a wire retaining element 22 and a magnetic member 24; securing a portion of a trailer wiring assembly 12 to the wire retaining element 22 of the retaining device 10; and magnetically attaching the magnetic member 24 of the retaining device 10 to a ferromagnetic surface 14, whereby the portion of the trailer wiring assembly 12 is secured to said ferromagnetic surface 14. Preferably, the step of magnetically attaching the magnetic member 24 to the ferromagnetic surface 14 is performed after the step of securing the portion of the trailer wiring 12 assembly to the wire retaining element 22 of the retaining device 10. As illustrated in FIG. 1, in the method of the present invention, the step of magnetically attaching the magnetic member 24 of the retaining device 10 to the ferromagnetic surface 14 includes attaching the magnetic member 24 to a vehicle bumper 14, though this step could similarly be performed by attaching the magnetic member 24 to a vehicle frame, a trailer frame or another ferromagnetic surface without departing from the scope of the invention. Preferably, the wire retaining element 22 comprises a flexible strap similar to that described above, and the step of securing the portion of the trailer wiring assembly 12 to the wire retaining element 22 of the retaining device 10 includes the step of wrapping the flexible strap 22 around the portion of the trailer wiring assembly 12. Preferably, a portion of the flexible strap 22 forms at least one adjustable loop 58 and the step of wrapping the flexible strap 22 around the portion of the trailer wiring assembly 12 includes the steps of positioning the portion of the trailer wiring assembly 12 within the loop 58 and then tightening the loop 58 to secure the portion of the trailer wiring assembly 12 to the retaining device 10. The device 10 is intended for use either while the electrical wires are in use or when they are not in use.

In view of the foregoing, it will be seen that the several advantages of the invention are achieved and attained. The embodiments disclosed herein were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A retaining device for trailer wiring comprising:

a main body portion;

at least one retaining element connected to the main body portion, said at least one retaining element being adapted for engagement with a first portion of a trailer wiring assembly in a manner for holding the first portion of the assembly relative to the main body portion; and a cohesive member connected to the main body portion, wherein the cohesive member comprises a magnetic member with a magnetic assembly having a permanent ceramic magnet bonded to a steel armature, the cohesive member being adapted for removably cohering the retaining device to a support having a ferromagnetic surface, the magnetic assembly comprising a cup assembly with the permanent magnet bonded in a steel cup.

2. The retaining device of claim 1 wherein the main body portion and at least a portion of the cohesive member are coated with an insulating material.

3. A retaining device for trailer wiring comprising:

a main body portion;

at least one retaining element connected to the main body portion, said at least one retaining element being adapted for engagement with a first portion of a trailer wiring assembly in a manner for holding the first portion of the assembly relative to the main body portion, wherein the retaining element comprises a flexible strap having one end secured to the main body portion, a portion of said flexible strap being adapted to loop around the first portion of the trailer wiring assembly in a manner for holding the first portion of the assembly relative to the main body portion; and a cohesive member connected to the main body portion, the cohesive member being adapted for removably cohering the retaining device to a support.

4. The retaining device of claim 3 wherein the flexible strap is made of polypropylene webbing.

5. The retaining device of claim 3 wherein the main body portion and at least a portion of the cohesive member are coated with an insulating material.

6. The retaining device of claim 3 wherein the main body portion includes first and second slots, each of said first and second slots being sized to permit said flexible strap to be threaded therethrough, and wherein said strap is threaded through said first and second slots in a manner to form a first loop, said first loop being adapted to wrap around the first portion of the trailer wiring assembly in a manner for holding the first portion of the assembly relative to the main body portion.

7. The retaining device of claim 6 wherein the main body portion includes third and fourth slots generally adjacent the first and second slots, each of said third and fourth slots being sized to permit said flexible strap to be threaded therethrough, and wherein said strap is threaded through said third and fourth slots in a manner to form a second loop, said second loop being adapted to wrap around a second portion of the trailer wiring assembly in a manner for holding the second portion of the assembly relative to the main body portion.

8. A retaining device for trailer wiring comprising:

a main body portion;

at least one retaining element connected to the main body portion, said at least one retaining element being adapted for engagement with a portion of a trailer wiring assembly in a manner for holding the portion of the assembly relative to the main body portion; and a magnetic member connected to the main body portion, the magnetic member being adapted for magnetically attaching the retaining device to a ferromagnetic support surface, the magnetic member comprising a magnetic assembly having a permanent ceramic magnet bonded to a steel armature, wherein the magnetic assembly is a cup assembly with the permanent magnet bonded in a steel cup.

9. The retaining device of claim 8 wherein the flexible strap is made of polypropylene.

10. A retaining device for trailer wiring comprising:

a main body portion;

at least one retaining element connected to the main body portion, said at least one retaining element being adapted for engagement with a portion of a trailer wiring assembly in a manner for holding the portion of the assembly relative to the main body portion, wherein the retaining element comprises a flexible strap having one end secured to the main body portion, a portion of said flexible strap being adapted to wrap around the portion of the trailer wiring assembly in a manner for holding the portion of the assembly relative to the main body portion, wherein the main body portion includes at least two slots, each of said at least two slots being sized to permit said flexible strap to be threaded therethrough, and wherein said strap is threaded through said at least two slots in a manner to form at least one loop, said at least one loop being adapted to wrap around the portion of the trailer wiring assembly in a manner for holding the portion of the assembly relative to the main body portion; and a magnetic member connected to the main body portion the magnetic member being adapted for magnetically attaching the retaining device to a ferromagnetic support surface.

11. The retaining device of claim 10 wherein the flexible strap is made of polypropylene.

12. A method of retaining trailer wiring, the method comprising the steps of:

providing a trailer wire retaining device having a wire retaining element and a magnetic member;

securing a portion of a trailer wiring assembly to the wire retaining element of the retaining device; and magnetically attaching the magnetic member of the retaining device to a ferromagnetic surface comprising one of a vehicle bumper, a vehicle frame and a trailer frame, whereby the portion of the trailer wiring assembly is secured to said ferromagnetic surface, wherein the wire retaining element comprises a flexible strap and the step of securing the portion of the trailer wiring assembly to the wire retaining element of the retaining device includes the step of wrapping the flexible strap around the portion of the trailer wiring assembly, and wherein a portion of the flexible strap forms an adjustable loop, and wherein the step of wrapping the flexible strap around the portion of the trailer wiring assembly includes the steps of positioning the portion of the trailer wiring assembly within the loop and then tightening the loop to secure the portion of the trailer wiring assembly to the retaining device.

13. The method of claim 12 wherein the step of magnetically attaching the magnetic member to the ferromagnetic surface is performed after the step of securing the portion of the trailer wiring assembly to the wire retaining element of the retaining device.

* * * * *